US009230521B2

(12) United States Patent
Laukat et al.

(10) Patent No.: US 9,230,521 B2
(45) Date of Patent: Jan. 5, 2016

(54) BASS CLARINET WITH LOW E TONE HOLE NOT ON THE BELL

(71) Applicants: Tevis Laukat, Sandy, UT (US); Daron Bradford, Orem, UT (US)

(72) Inventors: Tevis Laukat, Sandy, UT (US); Daron Bradford, Orem, UT (US)

( * ) Notice: Subject to any disclaimer, the term of this patent is extended or adjusted under 35 U.S.C. 154(b) by 0 days.

(21) Appl. No.: 14/519,024

(22) Filed: Oct. 20, 2014

(65) Prior Publication Data

US 2015/0107439 A1 Apr. 23, 2015

Related U.S. Application Data

(60) Provisional application No. 61/892,998, filed on Oct. 18, 2013.

(51) Int. Cl.
*G10D 7/06* (2006.01)

(52) U.S. Cl.
CPC ..... *G10D 7/066* (2013.01)

(58) Field of Classification Search
CPC ..... G10D 9/02; G10D 9/043; G10D 7/066
See application file for complete search history.

(56) References Cited

U.S. PATENT DOCUMENTS

| | | | | | |
|---|---|---|---|---|---|
| 110,845 | A | | 1/1871 | Fritsche | |
| 885,080 | A | | 4/1908 | Stahl | |
| 1,546,153 | A | | 7/1925 | Upton | |
| 1,817,487 | A | | 8/1931 | Heyworth et al. | |
| 2,390,275 | A | | 12/1945 | Runyon | |
| 2,649,829 | A | * | 8/1953 | Loney | 84/382 |
| 2,833,175 | A | * | 5/1958 | Leblanc | 84/382 |
| 3,163,074 | A | * | 12/1964 | Leblanc | 84/382 |
| 4,206,680 | A | | 6/1980 | Hanson et al. | |
| 4,809,580 | A | * | 3/1989 | Yamaryo | 84/382 |
| 4,848,206 | A | | 7/1989 | Yamaryo | |
| 8,183,449 | B2 | | 5/2012 | Paulus et al. | |
| 2015/0107439 | A1 | * | 4/2015 | Laukat et al. | 84/383 R |

* cited by examiner

*Primary Examiner* — Robert W Horn
(74) *Attorney, Agent, or Firm* — Schmeiser, Olsen & Watts, LLP

(57) ABSTRACT

A low E-flat bass clarinet with low E tone hole not on the bell is provided. The clarinet includes a mouthpiece coupled to a neck. The clarinet further includes an upper joint coupled to the neck on one end and coupled to a lower joint on an opposing end, the upper and lower joints comprising tone holes and associated key mechanisms mounted thereon, and further having thereon a finger spatula terminating in a cam end positioned adjacent to the lower end of the lower joint. The clarinet also includes an low E joint coupled to a lower end of the lower joint, the low E joint having a low E tone hole. Further, the clarinet includes a bell coupled to the lower end of the low E joint, the bell having no low E tone hole and no low E key mechanism located thereon.

20 Claims, 3 Drawing Sheets

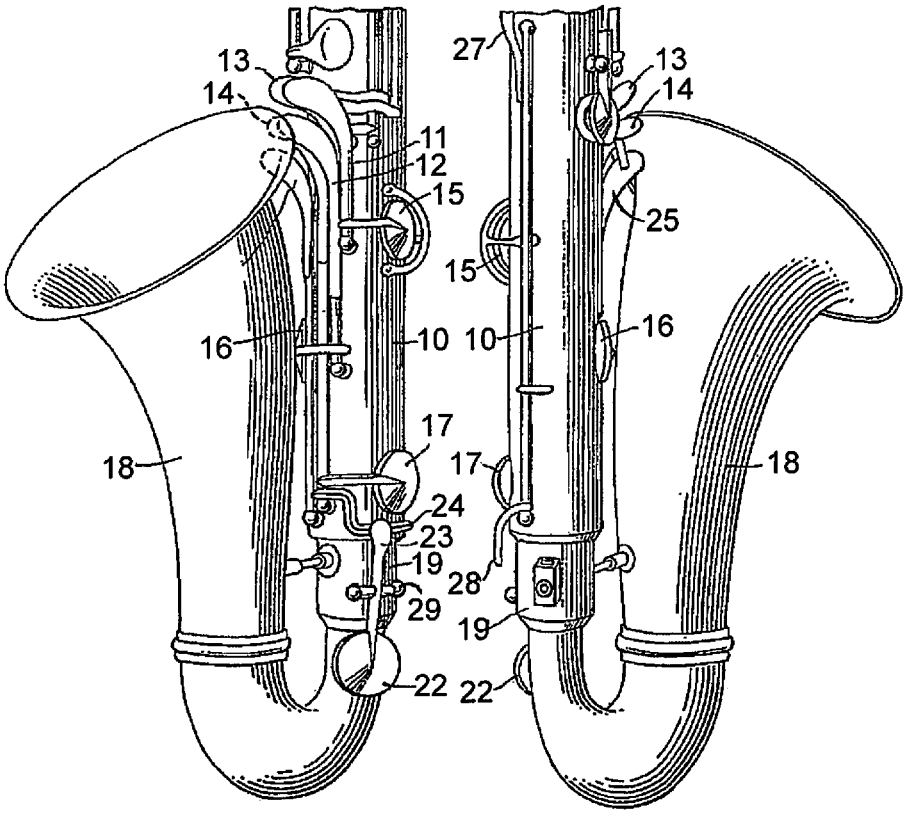
FIG. 1
(Prior Art)
FIG. 2
(Prior Art)
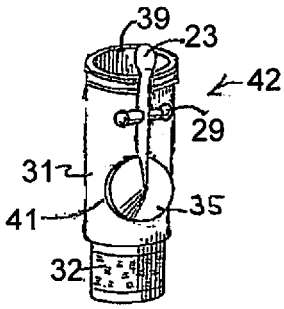
FIG. 3
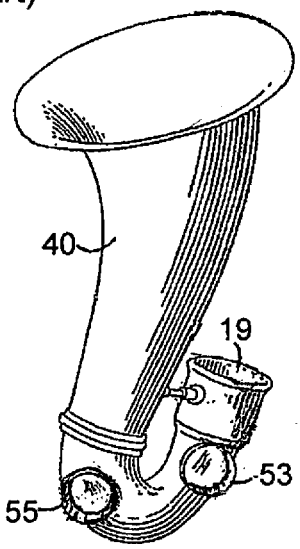
FIG. 4

BASS CLARINET WITH LOW E TONE HOLE NOT ON THE BELL

CROSS REFERENCE TO RELATED APPLICATION[S]

This application claims priority to U.S. Provisional Patent Application entitled "A BASS CLARINET WITH LOW E TONE HOLE NOT ON THE BELL," Ser. No. 61/892,998, filed Oct. 18, 2013, the disclosure of which is hereby incorporated entirely herein by reference.

BACKGROUND OF THE INVENTION

1. Technical Field

This invention relates to clarinets and more particularly to a Low Eb (E-flat) Bass Clarinet with the low E tone hole moved from the metal bell and placed on an additional joint positioned above the metal bell and below the traditional lower joint.

2. State of the Art

Bass clarinets as conventionally constructed with a low E tone hole. Many bass clarinet musical score parts, such as those used in traditional concert or chamber music, are written to require the playing of low E flat notes. Low Eb (E-flat) Bass Clarinets traditionally always have the low E flat tone hole located on the metal bell, as shown in FIG. 1, which is substantially thinner than the joint sections located above the bell, where all of the other tone holes are located.

Typical prior art patents that teach about the design, operation and assembly of clarinets and in particular bass clarinets, are herein incorporated by reference for their supportive teachings, are as follows: U.S. Pat. No. 110,845, U.S. Pat. No. 885,880, U.S. Pat. No. 1,546,153, U.S. Pat. No. 1,817,487, U.S. Pat. No. 2,390,275, U.S. Pat. No. 4,206,680, U.S. Pat. No. 4,848,206, and U.S. Pat. No. 8,183,449.

The sound produced by the low E flat tone hole is limited in its ability to be adjusted as the other tone holes in the low Eb clarinet because it is located on the bell section construction from thin metal. Accordingly, there is a need for a new design of the traditional Low Eb (E-flat) Bass Clarinets to allow for the easy adjustment of the tonal frequency thereof.

SUMMARY OF THE INVENTION

The present invention relates to a Low Eb (E-flat) Bass Clarinet with the low E tone hole moved from the metal bell and placed on an additional joint positioned above the metal bell and below the traditional lower joint.

In an embodiment of the present invention provides a Low Eb (E-flat) Bass Clarinet with the low E tone hole moved from the metal bell and placed on an additional joint positioned above the metal bell and below the traditional lower joint. The amount and shape of the material around the other tone holes in the joints is often modified to adjust the exact frequency of sound produced by that particular tone hole. Thus, by placing low E flat tone hole on the additional joint allows for the low E flat tone hole to be modified in a similar fashion as the other tone holes of the clarinet.

Uniquely, there is an embodiment, a low E-flat bass clarinet with a mouthpiece coupled to a neck, further including: a first joint, coupled to the neck, having tone holes and associated key mechanisms mounted thereon, and further having thereon a finger spatula terminating in a cam end positioned adjacent to the lower end of the first joint; a second joint, coupled to fit to a lower end of the first joint, having a low E tone hole thereon, and low E key mechanism having an operating finger coupled to the cam end and extending to a key that is positioned to cover the E tone hole; and a bell, coupled to fit on the lower end of the second joint, and having no key mechanism located thereon.

An embodiment may also include a low E-flat bass clarinet with a mouthpiece coupled to a neck. The clarinet further comprises an upper joint coupled to the neck on one end and coupled to a lower joint on an opposing end, the upper and lower joints comprising tone holes and associated key mechanisms mounted thereon, and further having thereon a finger spatula terminating in a cam end positioned adjacent to the lower end of the lower joint; an low E joint, coupled to fit to a lower end of the lower joint, the low E joint comprising a low E tone hole, and a low E key mechanism operatively coupled to the cam end and extending to a key that is positioned to cover the E flat tone hole; and a bell coupled to the lower end of the low E joint, the bell having no low E tone hole and no low E key mechanism located thereon. In further embodiments, the bell may comprise a tone adjustment hole on the bell.

An embodiment of the present invention may include A method of operating a low E-flat bass clarinet. The method may comprise coupling a mouthpiece to a neck; coupling an upper joint to the neck on one end; coupling a lower joint to the upper joint on an end opposing the end coupled to the neck, wherein the upper and lower joints comprise tone holes and associated key mechanisms mounted thereon, and further having thereon a finger spatula terminating in a cam end positioned adjacent to the lower end of the lower joint; coupling an low E joint to a lower end of the lower joint, the low E joint comprising a low E tone hole, and a low E key mechanism operatively coupled to the cam end and extending to a key that is positioned to cover the E flat tone hole; coupling a bell to the lower end of the low E joint, wherein the bell includes no low E tone hole and no low E key mechanism located thereon; and playing music by passing air through a reed of the mouthpiece and operating the key mechanisms.

Reference throughout this specification to features, advantages, or similar language does not imply that all of the features advantages that may be realized with the present invention should be or are in any single embodiment or the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

BRIEF DESCRIPTION OF THE DRAWINGS

In order for the advantages of the invention to be readily understood, a more particular description of the invention briefly described above will be rendered by reference to specific embodiments that are illustrated in the appended drawings. It is to be understood that these drawings depict only typical embodiments of the invention and are not therefore to be considered to be limiting of its scope, the invention will be described and explained with additional specificity and detail through the use of the accompanying drawings.

FIG. 1 is an elevation of the lower end portion of a conventional Low Eb (E-flat) Bass Clarinet with the low E tone hole located on the metal bell according to the prior art;

FIG. 2 is a similar view with the clarinet illustrated in FIG. 1 that is rotated through approximately 180 degrees;

FIG. 3 is an isometric view showing an extra joint assembly with a single low E tone hole and associated key mechanism located thereon;

FIG. 4 is a disassembled view showing a modified clarinet bell without the standard low E tone hole and associated keys located thereon;

DETAILED DESCRIPTION OF EMBODIMENTS OF THE INVENTION

Figure 5:
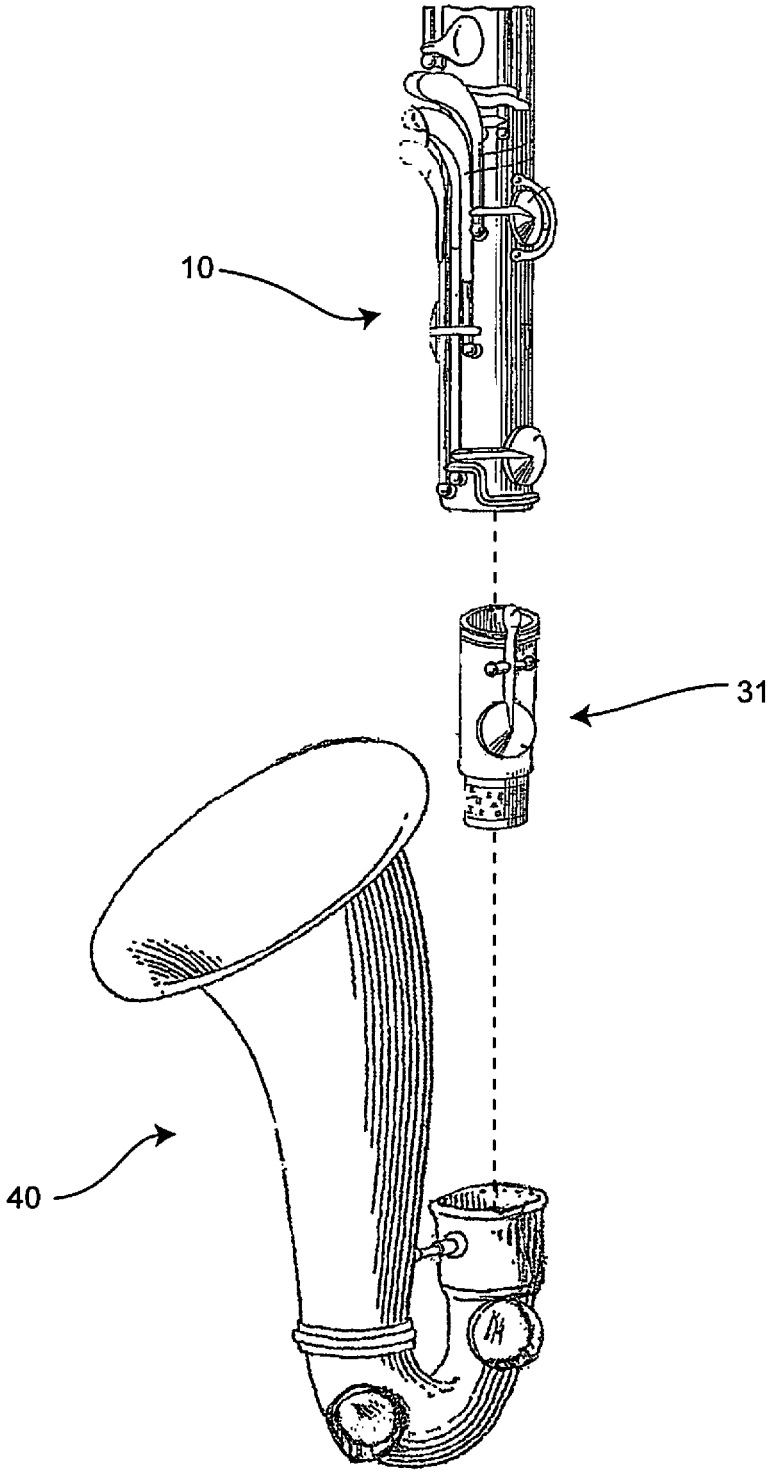
FIG. 5 is an exploded view showing a lower joint, an extra joint assembly with a single low E tone hole and a modified clarinet bell without the standard low E tone hole.

As discussed above, embodiments of the present invention relate to a Low Eb (E-flat) Bass Clarinet with the low E tone hole moved from the metal bell and placed on an additional joint positioned above the metal bell and below the traditional lower joint.

For the purposes of promoting an understanding of the principles of the invention, reference will now be made to the exemplary embodiment. Wherein, each statement of an embodiment is to be considered independent or any other embodiment, despite any use of similar or identical language.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Referring to FIGS. 1 and 2, there is illustrated one embodiment a prior art conventional Low Eb (E-flat) Bass Clarinet showing only a lower branch (or joint) 10 and an attached bell 18. The lower branch 10 carries a number of keys including four finger spatulas 11, 12, 13, and 14, which are arranged close together in the usual manner to be selectively engaged by the little finger of the player's right hand. As shown, the spatula 11 controls a key 15 on the lower branch and the spatula 12 controls a similar key 16 on the lower branch, further toward its lower end than the key 15. The spatula 13 controls a key 17 toward the extreme lower end of the branch 10. All of these keys are normally open and are adapted to be closed when the corresponding spatulas are engaged and depressed by the player.

The lower end of the joint 10 is adapted to receive a traditional bell 18 that terminates in an enlarged cup-shaped bell, and has a socket 19 (best seen in FIG. 4) to fit over a reduced end 21 at the lower end of the lower branch (not seen in FIGS. 1 and 2, but an exact match is shown in FIG. 3 as element 32). The lower branch 10 has a cylindrical longitudinal tone-carrying bore extending completely therethrough as in the conventional bass clarinet construction. When the lower branch 10 is assembled with the traditional bell 18, the opening through the bell 18 adjacent to the enlarged socket 19 forms a substantially smooth continuation of the bore throughout the entire instrument. The traditional thin metal bell 18 carries a key 22 that is adapted to close a low E tone hole opening (not shown, but located under key 22 as typically designed). For this purpose, the key terminates in an operating finger 23 that is adapted to overlie a cam end 24 when the bell 18 is assembled on the lower branch 10. The cam end 24 is connected to the spatula 14 to be swung outward from the lower branch when the spatula is depressed thereby to rock the key 22 to its closed position. The instrument as so far described is a purely conventional bass clarinet.

According to some of the present prior art, an additional finger spatula 25 may be provided on the lower branch lying closely adjacent to the spatulas 11 to 14. The spatula 25 is connected to an operating cam 26 that projects slightly beyond the lower end of the lower branch 10. Additionally, a thumb-operated spatula 27 may be mounted on the rear side of the lower branch substantially opposite to the spatulas 11 to 14 and 25 to be operated by the thumb of the player. These spatulas terminates in a cam end 28 which projects beyond the end of the lower branch on the side thereof opposite to the cam ends 24 and 26.

As shown in FIG. 3 through 5, there is one embodiment that allows for a thicker region around the E flat tone hole. Specifically, the traditional tone hole located on the bell 18, shown in FIG. 1, has been eliminated and moved to an extra joint 31 or low E joint 31, shown in FIG. 3. This low E joint 31 is formed using the same materials and methods as is joint 10, with a longitudinal tone carrying bore of the same size as the bore in the lower branch 10 and has in its upper end fitted with a socket 39 to snugly receive the reduced end 21 of the lower branch 10 as traditionally done in other similar traditional clarinet instruments. At its lower end, the extra joint 31 is formed with a reduced diameter mating end 32 designed to fit into the socket 19 of the modified bell 40 as shown in FIG. 4. It is noted that this reduced mating end 32, is designed exactly as the reduced end 21 of the lower joint 10 that is mated to the receiving socket 39.

To hold the extra joint 31 securely in place on the lower branch 10 a pivoted latch member 33 may be provided thereon to engage in a socket 34 located in the lower joint 10. This not only holds the extra joint securely on the lower branch 10, and accurately fixes the rotational relationship therebetween.

The extra joint 31 is formed with a low E tone hole 41 opening, that was previously located on the bell 18. There is also a key mechanism 42 made of a key 35, a pivot rod 29, and an operating finger 23 extending from the key 35 and having the pivot rod 29 perpendicularly extending loosely therethrough as illustrated. When the extra joint 31 is assembled on the lower branch 10, the operating finger 23 will overlie the cam end 24. In operation, when the spatula 14 is depressed the cam end 24 will contact operating finger 23 causing key mechanism 42 to pivot around pivot rod 29 and force key 35 to close the tone hole 41 in the extra joint 31.

Referring to FIG. 4, there is illustrated a new bell 40 design. Specifically, there is the elimination of the traditional low E tone hole and associated key mechanism that is illustrated in FIG. 1. Additionally, there are is at least one, but illustrating two, tone adjustment holes 53 and 55 located as illustrated. The tone adjustment holes may or may not have circular collars fitted and circumferentially positioned as illustrated.

The tone adjustment holes 53 and 55, adjust the tone of the notes played through the clarinet are particularly useful in creating a quality tone of notes being played because the low E joint 31 adds length to the clarinet. These tone adjustment holes 53 and 55 may adjust the resonance and/or the timbre, and accordingly may be referred to as resonance holes or timbre holes.

Regarding the assembly of the new instrument, it can easily be understood by those skilled in the art of making bass clarinets that the new design can be made from most of the conventional bass clarinet upper parts and attaching the extra joint 31 and new bell 40 as illustrated herein. More specifically, it will be easily understood to skilled artisan that the new instrument is now made of the lower joint 10 illustrated in FIG. 3 and all normal other parts associated with a bass clarinet that is located above the lower joint 10, whereby the new joint 31 will be coupled to the bottom of joint 10, and the new bell 40 will be coupled to the bottom of joint 31 by coupling the reduced mating end 32 to the bell socket 19. These changes or additions, however, are relatively simple and inexpensive ones and enable the player to utilize a conventional bass clarinet and modify, adjust or tune the low E tone hole by eliminating some of the material around the inner section of the tone hole as is customary to do to the other tone holes in the instrument. This may be referred to as undercutting the tone hole.

It is noted that although the application discusses and illustrates a single joint 10, one skilled in the art of designing clarinets and in particular bass clarinets will easily understand that several joints are commonly incorporated into the design of a traditional bass clarinet. Wherein, this disclosure teaches the addition of an additional joint 31 that incorporates the low E tone hole and related key mechanism and removes such from the typical metal walled bell 18 to allow for the advantages of having tone holes located on thicker walled portions of an instrument, which includes the tuning of notes by removal of material located in the tone hole.

Figure 6:
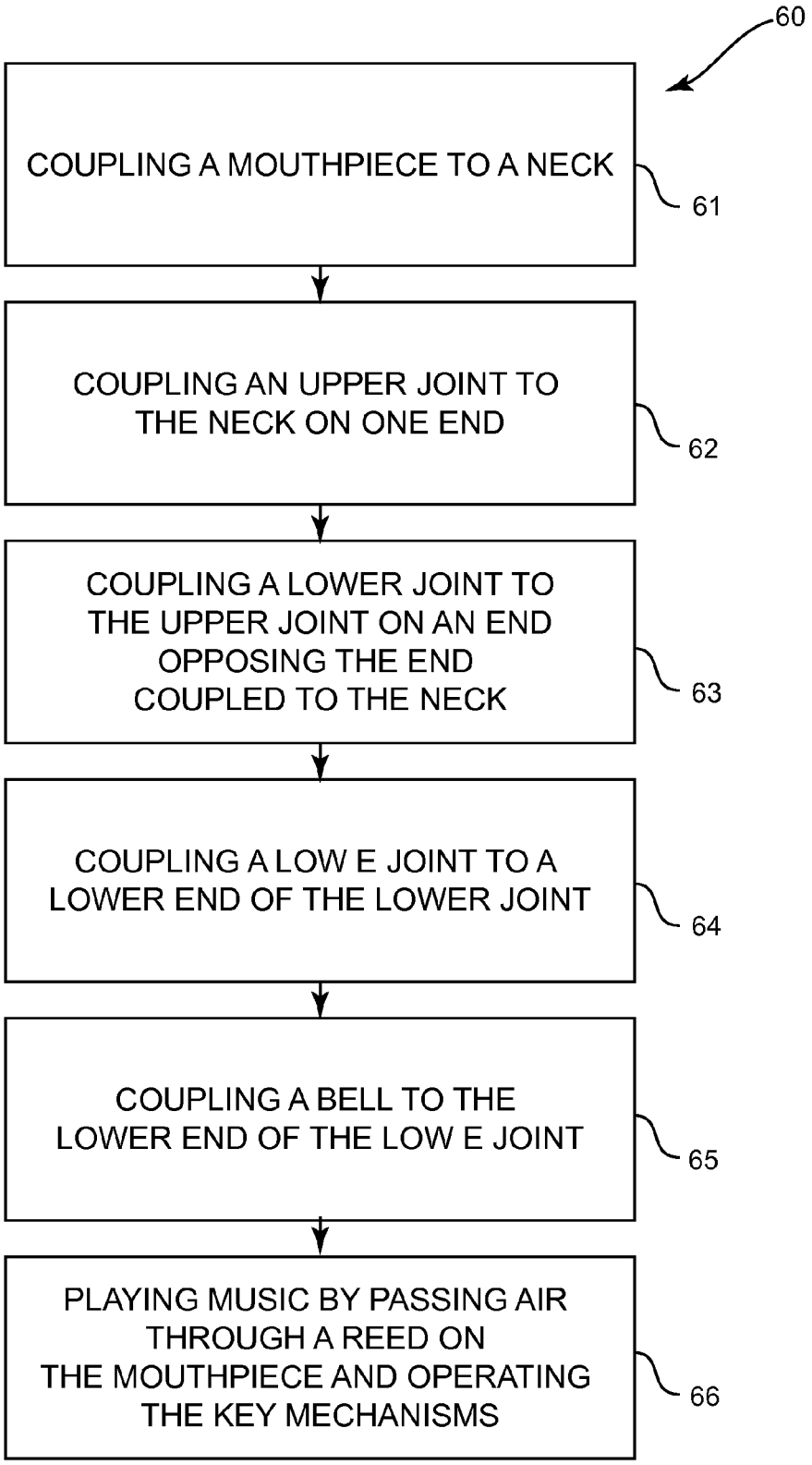
FIG. 6 is a method of operating a low E flat bass clarinet.

Referring to the drawings again, FIG. 6 depicts a flow chart of a method 60 of operating a low E flat clarinet. The method 60 includes coupling a mouthpiece to a neck (Step 61); coupling an upper joint to the neck on one end (Step 62); and coupling a lower joint to the upper joint on an end opposing the end coupled to the neck (Step 63). The upper and lower joints comprise tone holes and associated key mechanisms mounted thereon, and further having thereon a finger spatula terminating in a cam end positioned adjacent to the lower end of the lower joint. The method 60 may also include coupling a low E joint to a lower end of the lower joint (Step 64). The low E joint comprising a low E tone hole, and a low E key mechanism operatively coupled to the cam end and extending to a key that is positioned to cover the E flat tone hole. The method may also include coupling a bell to the lower end of the low E joint (Step 65), wherein the bell includes no low E tone hole and no low E key mechanism located thereon. Additionally, the method 60 may include playing music by passing air through a reed of the mouthpiece and operating the key mechanisms (Step 66).

Other steps in operating a low E flat clarinet are available and the method is not limited to these steps. For example, the method may include disassembling the clarinet, storing the components of the clarinet in a case and the like.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A low E-flat bass clarinet with a mouthpiece coupled to a neck, the clarinet comprising:

an upper joint coupled to the neck on one end and coupled to a lower joint on an opposing end, the upper and lower joints comprising tone holes and associated key mechanisms mounted thereon, and further having thereon a finger spatula terminating in a cam end positioned adjacent to the lower end of the lower joint;

a low E joint coupled to a lower end of the lower joint, the low E joint comprising a low E tone hole, and a low E key mechanism operatively coupled to the cam end and extending to a key that is positioned to cover the E flat tone hole; and a bell coupled to the lower end of the low E joint, the bell having no low E tone hole and no low E key mechanism located thereon.

2. The clarinet of claim 1, wherein the low E joint further comprising a latch, wherein the latch engages a socket located on the lower joint.

3. The clarinet of claim 1, wherein said bell is made from various types of metals.

4. The clarinet of claim 1, wherein the low E joint is configured for removal of material located at the tone hole.

5. The clarinet of claim 3, wherein the clarinet is tuned to play a note associated with the tone hole in the low E joint in response to removal of material from the tone hole.

6. A low E-flat bass clarinet with a mouthpiece coupled to a neck, said clarinet comprising:

an upper joint coupled to the neck on one end and coupled to a lower joint on an opposing end, the upper and lower joints comprising tone holes and associated key mechanisms mounted thereon, and further having thereon a finger spatula terminating in a cam end positioned adjacent to the lower end of the lower joint;

a low E joint, coupled to fit to a lower end of the lower joint, the low E joint comprising a low E tone hole, and a low E key mechanism operatively coupled to the cam end and extending to a key that is positioned to cover the E flat tone hole; and a bell coupled to the lower end of the low E joint, the bell having no low E tone hole and no low E key mechanism located thereon, the bell comprising a tone adjustment hole on the bell.

7. The clarinet of claim 6, wherein the low E joint further comprising a latch, wherein the latch engages a socket located on the lower joint.

8. The clarinet of claim 6, wherein said bell is made from various types of metals.

9. The clarinet of claim 6, wherein the low E joint is configured for removal of material located at the tone hole.

10. The clarinet of claim 9, wherein the clarinet is tuned to play a note associated with the tone hole in the low E joint in response to removal of material from the tone hole.

11. The clarinet of claim 6, wherein the tone adjustment hole comprises a circular collar.

12. The clarinet of claim 6, further comprising a second tone adjustment hole located on the bell.

13. A method of operating a low E-flat bass clarinet, the method comprising:

coupling a mouthpiece to a neck;

coupling an upper joint to the neck on one end;

coupling a lower joint to the upper joint on an end opposing the end coupled to the neck, wherein the upper and lower joints comprise tone holes and associated key mechanisms mounted thereon, and further having thereon a finger spatula terminating in a cam end positioned adjacent to the lower end of the lower joint;

coupling a low E joint to a lower end of the lower joint, the low E joint comprising a low E tone hole, and a low E key mechanism operatively coupled to the cam end and extending to a key that is positioned to cover the E flat tone hole;

coupling a bell to the lower end of the low E joint, wherein the bell includes no low E tone hole and no low E key mechanism located thereon; and playing music by passing air through a reed of the mouthpiece and operating the key mechanisms.

14. The method of claim 13, wherein playing music comprises activating the key mechanism of the low E joint.

15. The method of claim 13, wherein the bell comprises a tone adjustment hole.

16. The method of claim 15, wherein the tone adjustment hole comprises a circular collar.

17. The method of claim 13, wherein coupling an low E joint to the lower joint comprises engaging a latch mechanism coupled to the low E joint with a socket located on the lower joint.

18. The method of claim 13, wherein the low E joint is configured for removal of material located at the tone hole.

19. The method of claim 13, wherein the clarinet is tuned to play a note associated with the tone hole in the low E joint in response to removal of material from the tone hole.

20. The method of claim 13, further comprising disassembling the clarinet and storing the components in a case.

* * * * *